US006819993B2

(12) United States Patent
Koch

(10) Patent No.: US 6,819,993 B2
(45) Date of Patent: Nov. 16, 2004

(54) SYSTEM FOR ESTIMATING A LINKAGE POSITION

(75) Inventor: Roger D. Koch, Pekin, IL (US)

(73) Assignee: Caterpillar Inc, Peoria, IL (US)

( * ) Notice: Subject to any disclaimer, the term of this patent is extended or adjusted under 35 U.S.C. 154(b) by 18 days.

(21) Appl. No.: 10/317,368

(22) Filed: Dec. 12, 2002

(65) Prior Publication Data

US 2004/0117093 A1 Jun. 17, 2004

(51) Int. Cl.[7] ..... G06R 19/00; G06G 7/00

(52) U.S. Cl. ..... 701/50; 414/680; 414/699; 37/348; 37/414; 701/49

(58) Field of Search ..... 701/50, 1, 36, 701/49; 37/348, 414; 414/680, 699

(56) References Cited

U.S. PATENT DOCUMENTS 4,546,996 A 10/1985 Hanson
5,171,124 A 12/1992 Foster
5,704,141 A 1/1998 Miura et al.
5,957,989 A 9/1999 Egawa et al.
6,032,093 A 2/2000 Denbraber et al.
6,131,061 A 10/2000 Denbraber et al.
6,227,569 B1 * 5/2001 Dingeldein et al. ..... 280/764.1
6,230,090 B1 5/2001 Takahashi et al.
6,282,453 B1 8/2001 Lombardi
6,415,604 B1 7/2002 Motomura et al.
6,437,726 B1 8/2002 Price

* cited by examiner

*Primary Examiner*—Thomas G. Black
*Assistant Examiner*—Olga Hernandez
(74) *Attorney, Agent, or Firm*—Finnegan, Henderson, Farabow, Garrett & Dunner

(57) ABSTRACT

A system and method for estimating the position of a mechanical linkage is disclosed. An estimated position of a mechanical linkage is set to an initial position. The movement of the mechanical linkage is controlled based on a signal from an input device. The estimated position of the mechanical linkage is updated based upon the movement of the mechanical linkage. A determination is made when the estimated position of the mechanical linkage substantially corresponds to an actual position of the mechanical linkage.

22 Claims, 5 Drawing Sheets

SYSTEM FOR ESTIMATING A LINKAGE POSITION

TECHNICAL FIELD

This invention relates to a mechanical linkage. More particularly, this invention relates to a system and method for estimating the position of a mechanical linkage.

BACKGROUND

Work machines, such as, for example, excavators and backhoes, often have one or more mechanical linkages that may be used for any number of purposes. For example, a wheeled excavator may include a digging linkage that extends from the housing of the excavator and one or more stabilizing arm linkages that extend from opposite sides of the excavator. The stabilizing arms are adapted to be raised and lowered to engage the ground and provide support and stabilization for the excavator when operating the digging linkage. A digging linkage, on the other hand, is typically configured for additional degrees of freedom. For example, the digging linkage may be raised, lowered, rotated, and/or pivoted with respect to the excavator to provide a full range of digging motion. Occasionally, an operator will operate the digging linkage in close proximity to the stabilizing arms.

Because controlling the operation of the digging linkage of a work machine is complex, inexperienced operators may risk bringing a portion of the digging linkage into undesired contact with other components of the work machine, including the stabilizing arms and the work machine body. This undesired contact may cause damage to the work machine. This damage may be expensive to repair and may reduce the productivity of the work machine and the workers at the work site.

To reduce the chance of interference between linkages, it is desirable to know the position of the various mechanical linkages. Some work machines use complex electrical equipment, such as displacement transducers, to determine the position of the linkages. However, work machines, such as excavators, are often used in environments that are harsh on this type of electrical equipment. Transducers that are manufactured to perform well in such harsh environments are expensive. Accordingly, although it may be economically feasible to place such transducers on frequently used linkages, such as the digging linkage, it may not be equally economically feasible to place displacement transducers on less used mechanical linkages, such as the stabilizing arms. Thus, while the actual position of the digging linkage may be easy to determine, the actual position of the stabilizing arms may not be known, thereby making it difficult to prevent undesirable contact between the digging linkage and the stabilizing arms.

One method for avoiding undesired contact between the digging linkage and the stabilizing arms is to restrict the range of motion of the digging linkage so that it cannot intrude into the entire region in which the stabilizing arms function. One system for restricting the range of motion of a digging linkage is disclosed in U.S. Pat. No. 6,131,061 to Denbraber. Denbraber relates to an apparatus and method for preventing "under-digging" of a work machine. The system defines an under-digging boundary relative to the work machine and prevents the digging linkage from moving past the under-digging boundary. This prevents removal of material that may cause the ground on which the work machine rests to become unstable. The system monitors the position of the digging linkage and restricts movement of the digging linkage to prevent under-digging the work machine.

Although such an approach eliminates the chance of contact between the digging linkage and the stabilizing arms, this approach may unnecessarily restrict the motion of the digging linkage. In particular, this approach may prevent the digging linkage from moving into certain regions about the work machine, even when the digging linkage would not contact the stabilizing arms. It is desirable to estimate the position of linkages on the work machine, such as the stabilizing arms, without the use of transducers, to allow the greatest range of motion of the digging linkage, while still preventing the digging linkage from contacting the other linkages.

The system of the present invention is directed to overcoming one or more of the problems or disadvantages set forth above.

SUMMARY OF THE INVENTION

In one aspect, the present disclosure is directed to a method of estimating the position of a mechanical linkage. An estimated position of a mechanical linkage is set to an initial position. A movement of the mechanical linkage is controlled based on a signal from an input device. The estimated position of the mechanical linkage is updated based upon the movement of the mechanical linkage. A determination is made when the estimated position of the mechanical linkage substantially corresponds to an actual position of the mechanical linkage.

In another aspect, the present disclosure is directed to a method of estimating a position of a first linkage to avoid interference with a second linkage. A range of motion of the second linkage is limited to a preset range of motion. A movement of the first linkage is controlled based on signals from an input device. A position of the first linkage is estimated based upon the movement of the first linkage. The range of motion of the second linkage is expanded based upon the estimated position of the first linkage.

DETAILED DESCRIPTION

Figure 1:
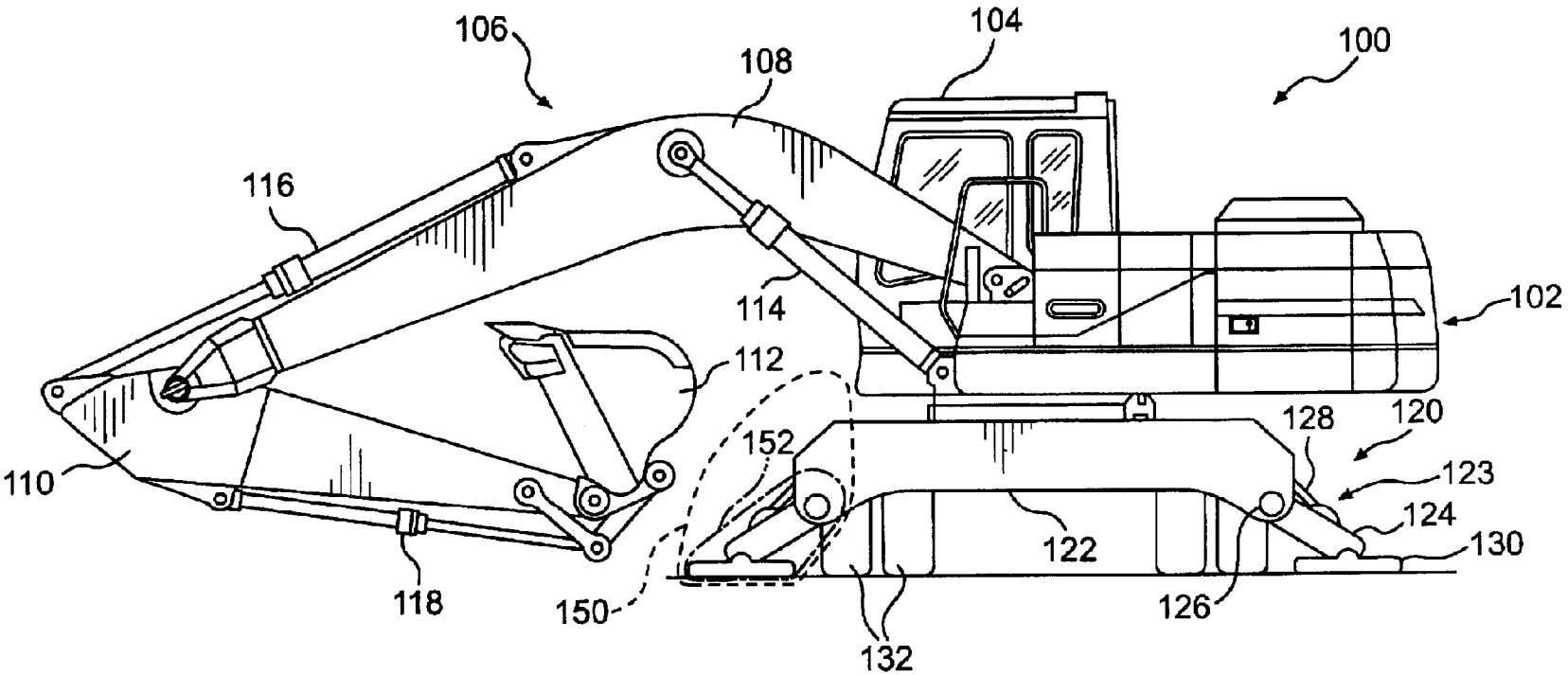
FIG. 1 is an elevational diagrammatic view of an exemplary work machine.

FIG. 1 illustrates an exemplary embodiment of a work machine 100 that may be utilized to perform numerous work functions such as, for example, digging and material movement. In this exemplary embodiment, the work machine 100 is a wheeled excavator. However, the work machine 100 could be any work machine having more than one moveable linkage, such as for example, a backhoe.

The work machine 100 includes a housing 102 having an operator's compartment 104. The operator's compartment 104 may contain input devices that may be used to control the operation and movement of the work machine 100. The input devices may include, for example, control lever assemblies and foot pedal assemblies.

The work machine 100 includes a digging linkage 106. The digging linkage 106 includes a boom 108, a stick 110, and a work implement 112. Movement of the digging linkage 106 may be accomplished by a boom cylinder actuator 114, a stick cylinder actuator 116, and a work implement cylinder actuator 118. These actuators are configured to provide a wide range of movement to the digging linkage 106, as is known to one skilled in the art.

The work machine 100 includes an undercarriage 120 having a frame 122 for supporting the housing 102. The housing 102 and the digging linkage 106 may be adapted to rotate relative to the frame 122 thereby providing the digging linkage 106 with a wide digging range. A ground engaging device, such as, for example, wheels 132 may be disposed on the frame 122 to facilitate moving the work machine 100 from one location to another, as is known in the art.

The frame 122 may also include at least one stabilizing arm 123. Stabilizing arm 123 may include an arm 124, a stabilizing actuator 128, and stabilizing pads 130. The stabilizing actuator 128 may be operated to raise or lower the stabilizing arm 123 about a pivot 126 on the frame 122. The stabilizing pads 130 are disposed at the end of the arm 124 and are designed to engage the ground. The stabilizing arm 123 may be used to stabilize and support the work machine 100 when the operator is moving the digging linkage 106 to perform a task, as is known to one skilled in the art.

The stabilizing arm 123 travels about the pivot 126 in a range extending from a storing position to a ground engaging position. The storing position of the stabilizing arm 123 is the position at which the stabilizing arm is moved furthest from the ground. The stabilizing arm 123 may be moved to the storing position before the work machine 100 is moved between locations. The ground engaging position, on the other hand, is a lowered position where the stabilizing arm 123 is expected to engage the ground to provide support for the work machine 100. The ground engaging position may depend upon the characteristics of the particular work site.

Figure 2:
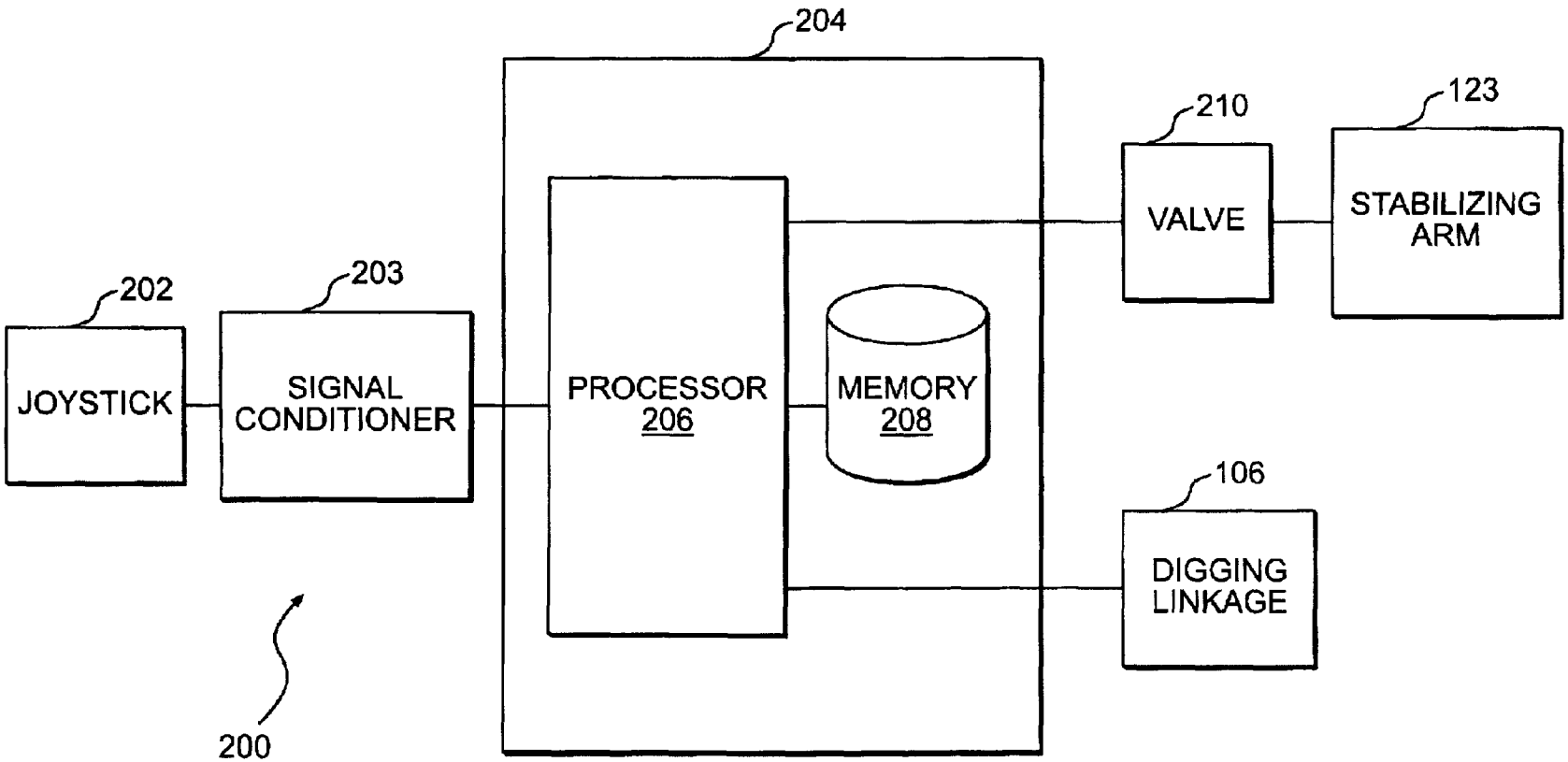
FIG. 2 is block diagrammatic illustration of a system for estimating a position of a mechanical linkage in accordance with an exemplary embodiment of the present invention.

FIG. 2 illustrates an exemplary control system 200 for determining and estimating the position of a mechanical linkage, such as the stabilizing arm 123 on the work machine 100. Although the control system 200 is described with relation to the stabilizing arms 123 for an excavator, the control system 200 could be used to estimate the position of any mechanical linkage on any machine, as would be apparent to one skilled in the art.

The control system 200 includes an input device, such as, for example, a joystick 202, that is operably associated with the work machine 100 for controlling the movement of the stabilizing arm 123. The joystick 202 may be housed within the operator's compartment 104, and could be part of a control lever assembly or any other standard input device for controlling and operating a mechanical linkage on a work machine.

When activated by an operator, the joystick 202 generates electronic signals as instructions to move the stabilizing arm 123. A signal conditioner 203 may provide conventional excitation, scaling, and filtering of the signals from the joystick 202. The electrical signals are then sent to a controller 204. In one exemplary embodiment, the signal conditioner 203 is part of the controller 204.

The controller 204 includes a processor 206 and a memory component 208. The processor 206 could be any processor for executing data structures or computer programs known in the art. The memory component 208 could be any standard memory component known in the art, and may be configured to store data such as data structures and/or computer programs, such as routines or sub-routines, that may be executable by the processor 206.

The controller 204 is adapted to control the setting of a valve 210. The controller 204 may generate and send signals from the processor 206 to the valve 210, based on data structures contained within the memory component 208. The valve 210 may be associated with the stabilizing actuator 128 and the setting of the valve 210 may control the rate and direction of movement of the stabilizing arm 123.

The controller 204 may also be adapted to control the movement of the digging linkage 106. The controller 204 may control the movement of the digging linkage 106 based on operator inputs through joystick 202. The controller 204 may generate and send signals based on the operator inputs and on data structures contained within the memory component 208. The signals may be sent to one or more valves (not shown) associated with the digging linkage 106. These signals may result in the opening and closing of the valves to thereby control the movement of the digging linkage 106.

The controller 204 may also be adapted to modify the input from the operator to alter or limit the motion of the digging linkage 106 to prevent the digging linkage 106 from contacting the stabilizing arm 123. To prevent undesirable contact between the digging linkage 106 and the stabilizing arm 123, the controller 204 calculates the position of the digging linkage 106 and estimates the position of the stabilizing arm 123. The controller 204 alters or limits the motion of the digging linkage 106 when the requested motion of the digging linkage 106 will move the digging linkage 106 into the estimated position of the stabilizing arm 123.

The controller 204 may monitor movement of the stabilizing arm 123 and thereby provide a more accurate estimated position of the stabilizing arm 123. This may allow for an increased potential range of motion of the digging linkage 106. When the controller 204 has a low confidence level in the actual position of the stabilizing arm 123, such as, for example, when the work machine 100 is initially started, the controller 204 may assume that the actual position of the stabilizing arm 123 is within a swept volume 150 (referring to FIG. 1). The swept volume 150 may represent the full range of possible positions for the stabilizing arm 123 between the storing position and the ground engaging position. When the position of the stabilizing arm 123 is regarded as the swept volume, the range of motion of the digging linkage 106 is limited so that the digging linkage 106 cannot travel through or operate within the swept volume 150. When an operator provides instructions through joystick 202 to move the digging linkage 106 into the swept volume 150, the controller 204 may override the operator input to prevent the digging linkage 106 from moving into the swept volume 150.

Controller 204 monitors the position of the stabilizing arm 123 to obtain an estimate of the actual position of the stabilizing arm 123. When the controller 204 is able to more accurately estimate the position of the stabilizing arm 123, the controller 204 may reduce the range of potential positions of the stabilizing arm 123 to a surround volume 152 (referring to FIG. 1). For example, if the controller 204 determines that the stabilizing arm 123 has moved a certain distance towards the storing position, the controller 204 may eliminate a corresponding portion of the lower range of motion of the stabilizing arm 123 as potential positions for the stabilizing arm 123. When the controller 204 reduces the range of potential positions of the stabilizing arm 123 from, for example, the swept volume 150 to the surround volume 152, the range of motion of the digging linkage 106 is increased to include the portion of the swept volume 150 that has been eliminated as a potential position for the stabilizing arm 123. Thus, as the position of the stabilizing arm 123 is more accurately estimated, the controller allows the digging linkage 106 to operate within an increased range.

Figure 3:
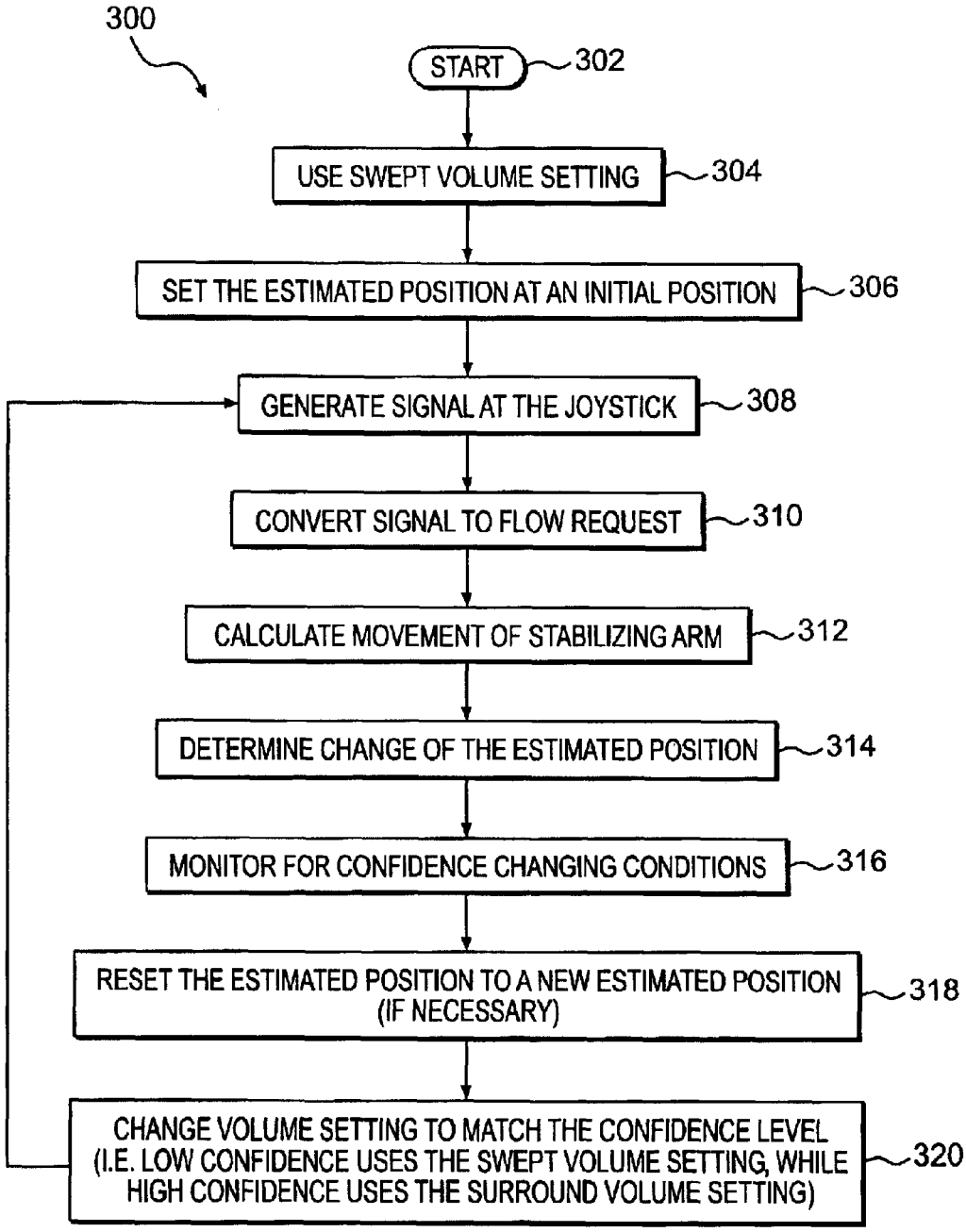
FIG. 3 is a flow chart showing a method for estimating a position of a mechanical linkage in accordance with an exemplary embodiment of the present invention.

FIG. 3 is a flow chart showing an exemplary method 300 for estimating the actual position of the stabilizing arm 123 by monitoring the movement of the stabilizing arm 123. The method 300 is a process that may be used by the controller 204, based on data structures within the memory component 208.

The method 300 starts at a start block 302. The start block 302 may represent an initial powering of the control system 200 and/or work machine 100. This may occur during the start-up of the work machine 100 or at some other point in the powering of the work machine 100. In one exemplary embodiment, the controller 204 performs the method 300 for estimating the position of a mechanical linkage each time the work machine 100 is powered.

At a step 304, the controller 204 uses a swept volume setting, where the potential range of positions for the digging linkage 106 is set at the swept volume 150. When using the swept volume setting, the controller 204 limits the range of motion of the digging linkage 106 to prevent the digging linkage 106 from intruding into the swept volume 150, which represents any position that the stabilizing arm 123 is capable of occupying. In this manner, the controller 204 removes any chance for contact between the digging linkage 106 and the stabilizing arm 123.

At a step 306, the controller 204 sets the estimated position of the stabilizing arm 123 at an initial position. The initial position is an assumed position of the stabilizing arm 123, and is not based on or related to the actual position of the stabilizing arm. In one exemplary embodiment, the initial position is a mid-position or mid-angle position, such as, for example, a position halfway between the storing position and the ground engaging position of the stabilizing arm 123.

The controller 204 assigns a low confidence level to the initial position because the initial position is an assumed value and does not necessarily correspond to the actual position of the stabilizing arm 123. A low confidence level indicates that the controller 204 can determine with only a low degree of certainty whether the current estimated position of the stabilizing arm 123 closely conforms to the actual position of the stabilizing arm 123. The controller 204 will not reduce the potential range of positions of the stabilizing arm 123 from the swept volume 150 until the controller determines with increased certainty that the current estimated position more closely conforms to the actual position of the stabilizing arm. At that time, the confidence level may be raised to a higher level.

At a step 308, an operator generates a control signal to govern the position of the stabilizing arm 123 using conventional methods, such as, for example, manipulating joystick 202. The control signal from the joystick 202 may be conditioned and sent to the controller 204. The controller 204 then controls the position of the valve 210 to initiate a corresponding movement of the stabilizing arm 123.

At a step 310, the controller 204 converts the control signal from the joystick 202 to a flow request. The flow request is a representation of the requested fluid flow rate to the stabilizing actuator 128. As one skilled in the art will recognize, the movement of the stabilizing actuator 128 and, thus, the stabilizing arm 123, is directly related to the rate and direction of fluid flow to the stabilizing actuator. The control signal from the joystick 202 may be empirically related to the requested fluid flow rate. This empirical relationship may be stored as a table, algorithm, or other data structure in the memory component 208. The processor 206 may access the table or algorithm to determine the flow request based on the control signal. In this manner, the requested fluid flow rate to the stabilizing actuator 128 may be easily calculated based on the control signal.

One skilled in the art will recognize that the flow request may be determined in other manners. For example, the flow request may be determined based on a sensed parameter of the system. In one exemplary embodiment, the controller 204 determines the flow request based on the degree of opening of the valve 210.

At a step 312, the controller 204 estimates the movement of the stabilizing arm 123. The controller 204 may estimate the velocity of the stabilizing arm 123 based on the size of the stabilizing actuator 128 and the flow request. The estimated velocity of the stabilizing actuator 128 will be substantially equivalent to the flow request divided by the size of the stabilizing actuator 128, such as, for example, the net head area of the stabilizing actuator 128. Given the length of time that the control signal is transmitted and the estimated velocity of the stabilizing actuator 128, the controller 204 may estimate the amount of movement of the stabilizing arm 123.

Figure 4:
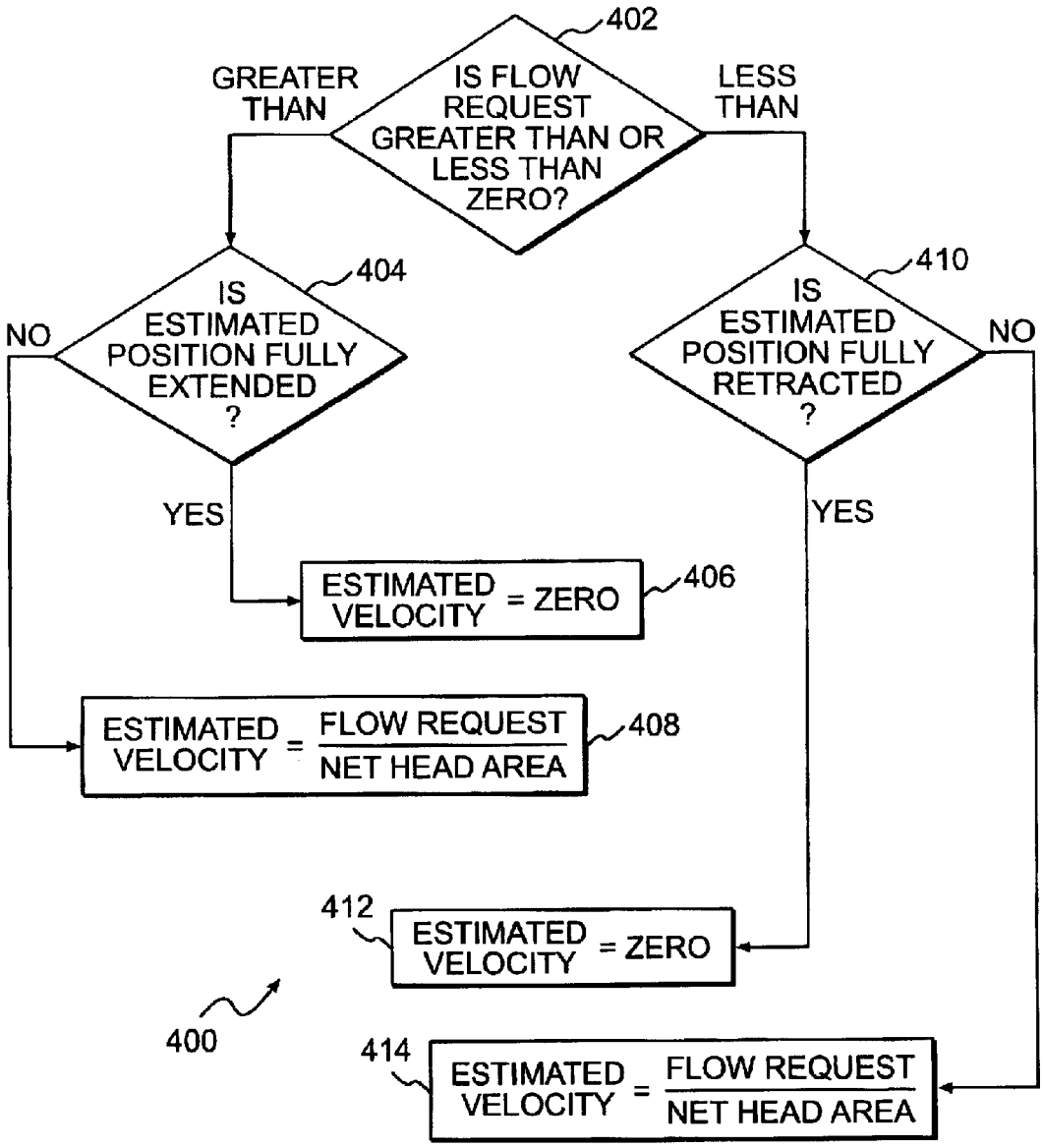
FIG. 4 is a flow chart showing a method for determining a rate of movement of a mechanical linkage in accordance with an exemplary embodiment of the present invention.

FIG. 4 is a flow chart showing a method 400 for estimating the velocity of the stabilizing arm 123 based on the flow request and the size of the stabilizing actuator 128 associated with the stabilizing arm 123. The method 400 may represent routines within one or more data structures that may be used to estimate the movement of the stabilizing arm.

At a step 402, the controller 204 determines whether the flow request is greater than or less than zero. A flow request that is greater than zero may indicate that fluid is flowing to the stabilizing actuator 128, whereas a flow request that is less than zero may indicate that fluid is flowing from the stabilizing actuator 128. A positive flow may indicate that the stabilizing actuator 128 is extending, such as may occur, for example, when the stabilizing arm 123 is descending toward the ground engaging position. A negative flow request may indicate that the stabilizing actuator 128 is retracting, such as may occur, for example, when the stabilizing arm 123 is being raised toward the storing position.

If the flow request is greater than zero, the controller 204 determines whether the estimated position of the stabilizing actuator 128 is fully extended at a step 404. When starting the system, the estimated position is set at the initial position, as described above. However, as described below, based on previous movements of the stabilizing arm 123, the estimated position of the stabilizing actuator 128 may have been set to the fully extended position. If the estimated position of the stabilizing arm 123 or the stabilizing actuator 128 is not at the fully extended position at step 404, then the estimated velocity equals the flow request divided by the net head area of the actuator, as shown at a step 408.

If the estimated position of the actuator 128 is at the fully extended position, then the estimated velocity of the actuator is set at zero at a step 406. The estimated velocity, or rate of change in position, is zero because the fully extended position represents the end of the range of motion of the stabilizing actuator 128 and, thus, the stabilizing actuator 128 is unable to extend any further. Although the estimated position may indicate that the actuator is fully extended, the actual position of the actuator may be only a nearly fully extended position. Accordingly, the actual actuator may be moving closer to the fully extended position, and closer to the estimated position.

Returning to step 402, if the flow request is not greater than zero, the data structure determines whether the estimated position is the fully retracted position at a step 410. If the estimated position is the fully retracted position, the system determines that the estimated velocity of the actuator is zero, at a step 412. If at step 410, the estimated position is not the fully retracted position, then at a step 414, the estimated velocity is determined to be equal to the flow request divided by the net head area.

Returning to FIG. 3, once the estimated velocity of the stabilizing actuator 128 is determined, the estimated movement of the stabilizing arm 123 may also be determined (step 312). The controller 204 may estimate the movement of the stabilizing arm 123 as a function of the estimated velocity of the stabilizing actuator 128 and the duration of the movement. In this manner, the amount of movement of the stabilizing arm 123 may be estimated.

It is contemplated that the actual movement of the stabilizing actuator 128 may be directly determined instead of estimated. For example, a fluid property may be measured to determine the actual movement of the linkage. In one embodiment, the fluid flow to the stabilizing actuator 128 through the valve 210 may be measured by a flow gauge, or other similar sensor, associated with a fluid pump. The actual movement of the stabilizing actuator 128 may be directly determined based upon the measured fluid flow and the size of the stabilizing actuator.

Referring again to FIG. 3, the controller 204 determines the change in the estimated position of the stabilizing arm 123 at a step 314. The estimated position of the stabilizing arm 123 is changed to correspond with the estimated movement of the stabilizing arm 128. For example, if the estimated movement of the stabilizing arm 123 was determined to be 25 degrees at step 312, then at step 314, the change in the estimated position would be 25 degrees. As one skilled in the art will recognize, the change in the estimated position of the stabilizing arm 123 may be accomplished using an integrating data structure configured to provide numerical integration of the velocity or movement of the actuator.

At a step 316, the controller 204 monitors operational parameters to determine a level of confidence associated with the estimated position of the stabilizing arm 123. The controller 204 may identify confidence changing conditions that indicate that the estimated position of the stabilizing arm 123 closely conforms to the actual position of the stabilizing arm 123. Exemplary confidence changing conditions are described with reference to FIG. 5.

Figure 5:
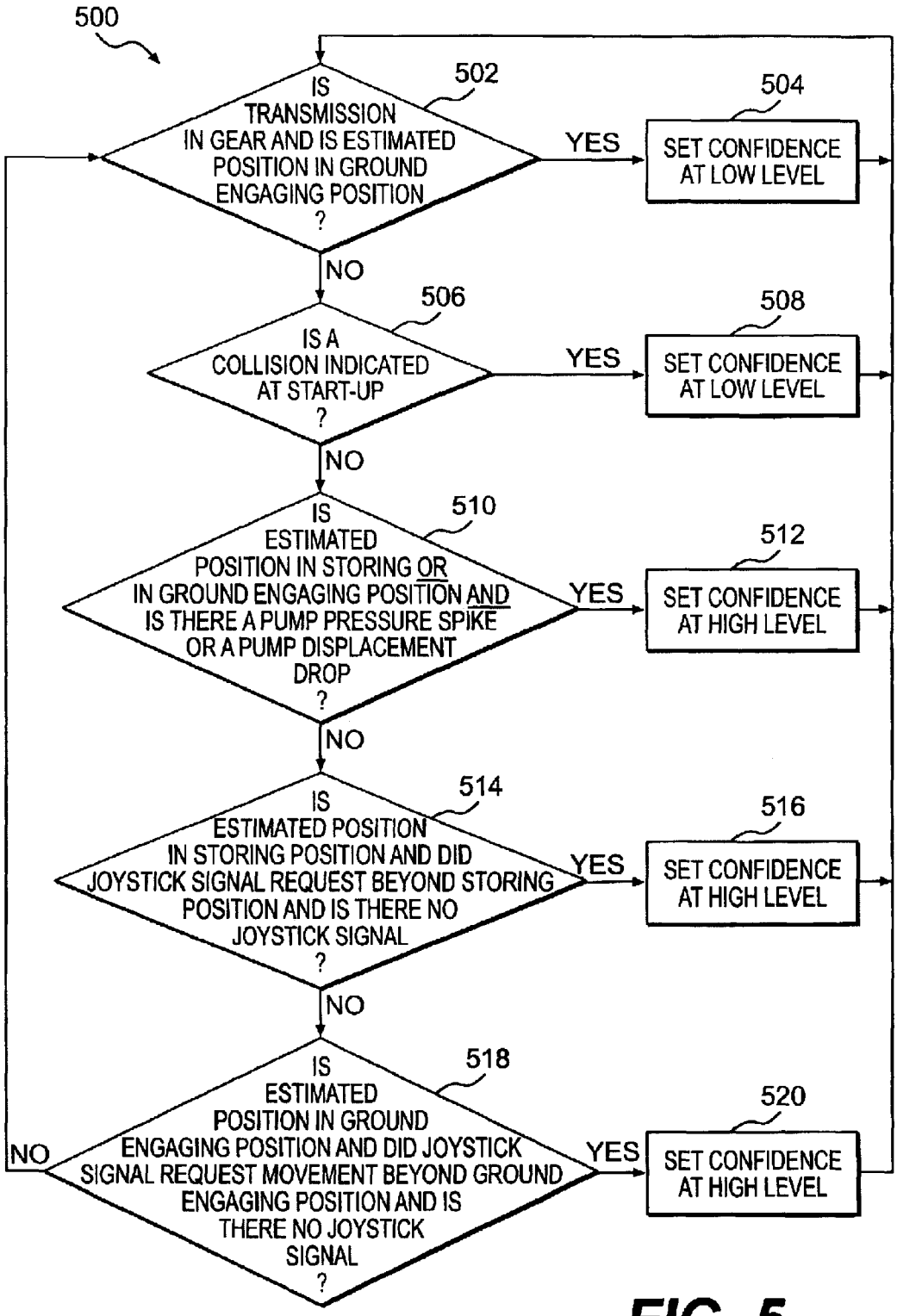
FIG. 5 is a flow chart showing a method for changing confidence settings of an estimated position of a mechanical linkage in accordance with an exemplary embodiment of the present invention.

FIG. 5 illustrates a method 500 of identifying one or more of several exemplary confidence changing conditions that may increase or decrease the confidence level associated with the estimated position of the stabilizing arm. The conditions may be continuously monitored to determine whether the confidence level should be increased or decreased.

At step 502, the controller 204 determines whether the transmission is in gear and whether the estimated position of the stabilizing arm is in a ground engaging position. If the system determines that the transmission is in gear and that the estimated position is in the ground engaging position, the confidence level is set at a low level as shown at step 504. This is because an operator is not likely to drive or move the work machine 100 when the stabilizing arms 123 are in the ground engaging position. Accordingly, such a condition indicates that the estimated position is not a good indicator of the actual position of the stabilizing arm 123.

At a step 506, the controller 204 determines whether a collision between the digging linkage 106 and the stabilizing arm 123 is indicated at the start-up, or initial powering of controller 204. As stated above, at the start-up, the estimated position is set to an initial position which, in the embodiment described, is a mid-position. If, for example, transducers disposed on the digging linkage 106 show that the digging linkage 106 occupies the mid-position of the stabilizing arm 123, then the confidence level is set at a low value, as shown at a step 508, because both the digging linkage 106 and the stabilizing arm 123 cannot occupy the same position.

At a step 510, the controller 204 monitors the operation of a fluid pump to determine the confidence level associated with the current estimated position. For example, the controller 204 may monitor the fluid pump to identify a pressure spike or a displacement drop. When the stabilizing actuator 128 reaches the end of a direction of travel, such as when the stabilizing arm 123 reaches the storing position, the stabilizing actuator 128 will stop moving. The stop in movement will cause a spike in the pressure of the fluid being directed to the stabilizing actuator 128 and/or a drop in the displacement of the pump. One or more sensors, such as, for example, a pressure transducer or a flow gauge, may be associated with the pump to identify either a pressure spike or a displacement drop.

The confidence level associated with an estimated end of motion position, such as the storing position or the ground engaging position, may be set to high at step 516 if accompanied by a pressure spike or a displacement drop. For example, if the estimated position of the stabilizing arm 123 is the storing position and the controller 204 identifies a pressure spike and/or a displacement drop, the controller 204 may set the confidence level associated with the estimated storing position to high. Similarly, if the estimated position of the stabilizing arm 123 is the ground engaging position and the controller 204 identifies a pressure spike and/or a displacement drop, the controller 204 may set the confidence level associated with the estimated ground engaging position to high.

At a step 514, the controller 204 monitors the control signal from the joystick 202 to determine the confidence level associated with the estimated position. The controller 204 may determine whether the estimated position is at the storing position, whether the joystick signal previously requested movement beyond the estimated storing position, and whether there is no current joystick signal. If each of these conditions are met, then the confidence level may be set at a high level, as shown at a step 516.

The high level of confidence in the estimated position follows from the joystick request for continued movement of the stabilizing arm 123 beyond the estimated storing position. For this situation to arise, the estimated position of the stabilizing arm 123 must have moved from, for example, the initial position to the storing position. The operator, however, is requesting that the stabilizing arm 123 continue to move towards the storing position. Accordingly, the actual initial position of the stabilizing arm 123 must have differed from the estimated initial position of the stabilizing arm. However, the continued movement of the stabilizing arm 123 causes the stabilizing arm to move closer to the storing position. Thus, when the joystick signal stops, the actual position of the stabilizing arm 123 will either correspond to or nearly correspond to the estimated position of the stabilizing arm 123. Accordingly, the confidence level associated with the estimated position may be set at a high level.

Similarly, a step 518 determines whether the estimated position is in the ground engaging position, whether the joystick signal requested movement beyond the estimated ground engaging position, and whether there is no current joystick signal. The step 518 determines that the estimated position either corresponds to or nearly corresponds to the actual position, using the logic described above with respect to step 516. If these conditions are met, the confidence level is set at a high level at a step 520.

As shown in the method 500, the system continually runs through these conditions to determine whether the level of confidence should be raised or lowered, depending upon the conditions met. If the none of the conditions are met, the level of confidence remains unchanged.

The confidence level, as used herein, is an indication of the degree of accuracy with which the estimated position of the stabilizing arm 123 corresponds to the actual position. While the described embodiment has a low and a high confidence level, the confidence level may include a number of tiered levels ranging from between the low level of confidence and the high level of confidence. As the confidence level increases, the swept volume 120 gradationally decreases toward the surround volume 152. In another exemplary embodiment, the confidence level is gradually increased or decreased. The range of motion of the digging linkage 106 inversely responds in a manner that allows the range of motion of the digging linkage 106 to also gradually increase or decrease. In yet another exemplary embodiment, the confidence level is numerically quantified, with each quantifiable number representing a different sized range of motion of the digging linkage 106. The confidence levels may be based upon a single factor or a number of factors that may give an indication of the actual position of the stabilizing arm 123.

Returning to FIG. 3, at a step 318, the estimated position of the stabilizing arm 123 is reset to a different estimated position as determined by any of the conditions set forth with respect to flow chart of FIG. 5. For example, if a pump pressure spike indicates that the actual position of the stabilizing arm 123 is at the storing position, but the estimated position is not quite at the storing position, then the estimated position may be reset to the storing position. Similarly, if the system determines at start-up that the digging linkage 106 is located at the initial position, then the initial position may be reset to a storing position because the digging linkage 106 and the stabilizing arm 123 cannot occupy the same space.

Likewise, the estimated position of the stabilizing arm 123 may be reset to the storing position or the ground engaging position when the controller 204 determines that the estimated movement is greater than or equal to the movement required to move the linkage from the initial position to the storing or ground engaging positions, respectively.

At a step 320, the volume setting is changed to correspond to the confidence level. For example, if the confidence level is low, the system uses the swept volume setting, thereby limiting the range of motion in which the digging linkage 106 may operate. Accordingly, the digging linkage 106 and the stabilizing arm 123 cannot come into contact. The range of motion of the digging linkage 106 may be limited using methods known in the art.

If the confidence level is high, the system uses the surround volume setting. The surround volume setting more closely follows the shape of the stabilizing 123 arm at the estimated position. Although the digging linkage 106 is not allowed to enter the surround volume, the surround volume is much smaller than the swept volume. Thus, the movement of the digging linkage 106 is not as limited, giving the digging linkage 106 an increased range of motion.

In one exemplary embodiment, the estimated position, once determined, may be saved in a memory component, such as, for example, the memory component 208. In this exemplary embodiment, the estimated position is determined using the method described in the flow chart 300 during a prior use of the work machine 100.

INDUSTRIAL APPLICABILITY

The above-described system and method estimates the position of a mechanical linkage without the use of expensive transducers. Knowing the estimated position allows a control system to increase the range of motion of other mechanical linkages without risking undesirable contact between the linkages. Accordingly, a mechanical linkage having a known position, such as a digging linkage, may be allowed to operate either above or below the estimated position of another mechanical linkage, such a stabilizing arm, with little risk of contact between the mechanical linkages.

Because the described system does not rely on position transducers to estimate the position of a mechanical linkage, the overall cost associated with the work machine is reduced. In addition, the maintenance costs associated with maintaining the transducers is reduced. It is expected that the disclosed position estimating system may be used on any machine having more than one mechanical linkage or assembly extending from the body of the machine, including, but not limited to, actuators and backhoes. The range of movement of the digging linkage may be incrementally adjusted, or alternatively, directly increased or decreased in proportion to an increase or decrease in the confidence level. It is contemplated that other options and methods for adjusting the range of motion to correspond to the confidence level may be made available.

Other embodiments of the invention will be apparent to those skilled in the art from consideration of the specification and practice of the invention disclosed herein. It is intended that the specification and examples be considered as exemplary only, with a true scope of the invention being indicated by the following claims.

What is claimed is:

1. A method of estimating the position of a mechanical linkage, comprising:

setting an estimated position of a first mechanical linkage to an initial position;

controlling a movement of the first mechanical linkage based on a signal from an input device;

updating the estimated position of the first mechanical linkage based upon the movement of the first mechanical linkage;

determining when the estimated position of the first mechanical linkage substantially corresponds to an actual position of the first mechanical linkage; and modifying a range of motion of a second linkage when the estimated position and the actual position of the first mechanical linkage substantially correspond.

2. The method of claim 1, further including:

assigning a confidence level to the estimated position of the first mechanical linkage;

adjusting the confidence level based on the monitoring of designated conditions; and wherein the adjusted confidence level is used when determining when the estimated position and the actual position of the first mechanical linkage substantially correspond.

3. The method of claim 1, further including:

moving the first mechanical linkage toward a storing position;

determining when the movement of the first mechanical linkage is greater than or equal to the movement required to move the first mechanical linkage from the initial position to the storing position; and setting the estimated position to be the storing position.

4. The method of claim 1, further including:

moving the first mechanical linkage toward a ground engaging position;

determining when the movement of the first mechanical linkage is greater than or equal to the movement required to move the first mechanical linkage from the initial position to the ground engaging position; and setting the estimated position to be the ground engaging position.

5. The method of claim 1, further including:

monitoring a parameter of a pump; and setting the estimated position of the first mechanical linkage to a storing position or a ground engaging position when the monitored parameter of the pump indicates a spike in pump outlet fluid pressure.

6. The method of claim 1, further including:

monitoring a parameter of a pump; and setting the estimated position of the first mechanical linkage to a storing position or a ground engaging position when the monitored parameter of the pump indicates a drop in the pump displacement.

7. The method of claim 1, wherein the second linkage is a digging linkage, the method further including:

limiting the range of motion of the digging linkage; and modifying the range of motion includes increasing the range of motion of the digging linkage when the estimated position and the actual position of the mechanical linkage substantially correspond.

8. The method of claim 1, further including:

emitting a signal from the input device to move the first mechanical linkage; and determining the estimated position of the first mechanical linkage based upon the emitted signal.

9. The method of claim 1, further including:

opening a valve to allow fluid to flow to or from the first mechanical linkage based upon signals received from the input device;

measuring a property of the fluid flow; and determining the movement of the first mechanical linkage from the initial position based upon the measured fluid property.

10. The method of claim 9, wherein the fluid property is a flow rate, and wherein a velocity of the movement of the first mechanical linkage is determined based on the flow rate and the size of an actuator associated with the first mechanical linkage.

11. A method of estimating a position of a first linkage to avoid interference with a second linkage, comprising:

limiting the range of motion of the second linkage to a preset range of motion;

controlling movement of the first linkage based on signals from an input device;

estimating a position of the first linkage based upon the movement of the first linkage; and expanding the range of motion of the second linkage based upon the estimated position of the first linkage.

12. The method of claim 11, wherein the range of motion of the second linkage is limited to the preset range of motion when the estimated position of the first linkage is at a first confidence level.

13. The method of claim 12, further including increasing the range of motion of the second linkage when the confidence level of the estimated position of the first linkage increases from the first level.

14. A control system for estimating a position of a first mechanical linkage, comprising:

an input device configured to control the movement of the first mechanical linkage;

an actuator associated with the input device for responding to the input device to move the first mechanical linkage; and a controller configured to set an estimated position of the first mechanical linkage to an initial position, to update the estimated position of the first mechanical linkage based upon the movement of the first mechanical linkage from the initial position, and to monitor designated parameters to determine when the estimated position and the actual position substantially corresponds, and wherein the controller is configured to modify a range of motion of a second linkage when the estimated position and the actual position of the first mechanical linkage substantially correspond.

15. The system of claim 14, wherein the input device is a joystick disposed within an operator compartment of a work machine.

16. The system of claim 14, wherein the controller is configured to update the estimated position of the first mechanical linkage based on a fluid flow to the actuator.

17. The system of claim 14, wherein the controller is configured to update the estimated position of the first mechanical linkage based on a velocity of the actuator as determined by control signals originating from the input device.

18. A control system for estimating the position of a first linkage to avoid interference with a second linkage, comprising:

an input device configured to control a movement of the first linkage; and a controller configured to limit the range of motion of the second linkage to a preset range of motion, to estimate a position of the first linkage based upon movement of the first linkage, and to expand the range of motion of the second linkage based upon the estimated position of the first linkage.

19. The system of claim 18, wherein the controller is configured to associate a confidence level with the estimated position of the first linkage and to limit the range of motion of the second linkage to the preset range of motion when the estimated position of the first linkage is at a first confidence level.

20. The system of claim 18, wherein the controller is configured to estimate the position of the first linkage based upon movement of the first linkage from an initial position.

21. The system of claim 18, wherein the controller is configured to associate a confidence level with the estimated position of the first linkage and to expand the range of motion of the second linkage when the confidence level associated with the estimated position of the first linkage increases.

22. A method of estimating the position of a stabilizing arm on a work machine having a digging linkage, comprising:

setting an estimated position of the stabilizing arm to an initial position;

limiting the range of motion of the digging linkage to prevent the digging linkage from crossing a boundary defining a swept volume surrounding the stabilizing arm;

operating an input device to generate control signals configured to initiate movement of the stabilizing arm;

determining an estimated movement of the stabilizing arm based upon the control signals;

updating the estimated position of the stabilizing arm based upon the estimated movement of the stabilizing arm;

increasing a confidence level associated with the estimated position of the stabilizing arm when the estimated position of the stabilizing arm substantially corresponds to an actual position of the stabilizing arm; and increasing the range of motion of the digging linkage when the confidence level associated with the estimated position of the stabilizing arm increases.

* * * * *